US005331692A

United States Patent [19]

Alberti

[11] Patent Number: 5,331,692

[45] Date of Patent: Jul. 26, 1994

[54] SPRAY APPARATUS FOR USE ON A TOILET SEAT

[76] Inventor: John Alberti, 2345 W. Halladay, Seattle, Wash. 98199

[21] Appl. No.: 56,874

[22] Filed: May 5, 1993

[51] Int. Cl.[5] ..... A47K 7/08

[52] U.S. Cl. ..... 4/445; 4/447; 4/443; 4/420.4

[58] Field of Search ..... 4/443, 444, 445, 446, 4/447, 448, 420.4, 569; 239/562, 281

[56] References Cited

U.S. PATENT DOCUMENTS

| | | | |
|---|---|---|---|
| 2,753,570 | 6/1956 | Evans | 4/448 |
| 3,423,024 | 1/1969 | Morawetz | 239/242 |
| 3,570,015 | 3/1971 | Rosengaus | 4/420.4 |
| 4,041,553 | 8/1977 | Sussman | 4/447 |
| 4,553,274 | 11/1985 | Yui | 4/447 |
| 5,247,711 | 9/1993 | Kwon | 4/420.4 |

*Primary Examiner*—Henry J. Recla
*Assistant Examiner*—Gregory Vidovich
*Attorney, Agent, or Firm*—Robert W. Jenny

[57] ABSTRACT

The apparatus comprises a manifold rotatably attached to the undersurface of a toilet seat extending from front to back and shaped so that when it is rotated against the undersurface it skirts the opening in the seat. A lever is provided at the front end of the manifold for use in moving it between its in use position with the plane of the manifold normal to the undersurface and its stowed position, essentially flat against the undersurface. The back end of the manifold is joined by a rotary joint to a supply tube, also mounted on the undersurface near the back of the seat and at a right angle to the manifold. A valve in this tube controls flow to the manifold. There are several orifices in the manifold, directing flow upward when the manifold is in use. There are movable sleeves on the manifold, one near each orifice, used to close off any orifice(s) when desired. In its stowed position the portion of the manifold in which the orifices are located lies in a channel attached to the undersurface. The flanges of the channel direct flow to clean the manifold and prevent spray from escaping through the space between the seat and bowl rim.

6 Claims, 2 Drawing Sheets

SPRAY APPARATUS FOR USE ON A TOILET SEAT

BACKGROUND OF THE INVENTION

1. Field

This subject invention is in the field of spray apparatus used for applying water for cleansing purposes. More specifically, it is in the field of such apparatus for washing parts of the human body and, still more specifically, the crotch area, similar to the function of a bidet. Further, it is in the field of apparatus which incorporates the function of a bidet into a conventional toilet.

2. Prior Art

The U.S. patents listed below provide a sample of the known prior art in this specific field.

| | |
|---|---|
| *4,094,018 | *4,406,025 |
| *4,304,016 | 4,551,867 |
| 4,321,715 | 4,596,058 |
| *4,334,339 | *4,628,548 |
| 4,383,339 | 4,411,030 |
| *4,391,004 | *4,807,311 |

The asterisked patents illustrate prior art of particular interest, each disclosing bidet apparatus which is installed into or onto a conventional toilet bowl/toilet seat combination. Each apparatus includes a variety of features including some but not all of the following:

a) the spray source can be adjusted to a number of locations b) The spray head and conduit leading to it can be stowed out of the way.

c) The spray source is self cleaning.

d) Multiple pressure levels are available.

Furthermore, those apparatuses which include more than two of the listed features tend to be rather complicated, the apparatus of U.S. Pat. No. '018 in particular. Accordingly, the prime objective of the subject invention is to provide spray apparatus for use on a toilet seat, the apparatus providing adjustable spray source location with variable pressure spray, as well as having a stowable and self cleaning spray source and conduit to the source. A second objective is that the apparatus be uncomplicated and simple to install and use, particularly as equipment retrofittable on existing toilets.

SUMMARY OF THE INVENTION

The subject invention is spray apparatus installed on a toilet seat to provide the functions of a bidet. The basic part of the apparatus is a manifold, made of tubing in a preferred embodiment, pivotally attached to the underside of a toilet seat and extending from front to back. The portions pivoted to the underside of the seat are close to that surface. The portion which bridges the opening is arched away from the plane of that surface. The shape of the arched portion is such that at its lowest point it is just above the level of the water in the toilet. It may be made telescopic to adapt the apparatus to a range of sizes of toilet seats. There is a plurality of openings in the arched portion with their centerlines in the plane of the centerline of the manifold. When the manifold is positioned with this vertical plane, water sprayed from the openings is directed upward and, for the openings in the sloped portions of the arched portion, upward and canted to various degrees toward the back-to-front center of the opening in the toilet seat. A lever is attached to the front end of the manifold. The lever is used to rotate the manifold from its vertical, in-use position to its stowed position essentially flat against the bottom surface of the seat. In this position the manifold skirts the opening in the seat and is completely out of sight. A channel is attached to the bottom of the seat and shaped and positioned so that the manifold is between the flanges of the channel when the manifold is stowed. One flange is positioned between the manifold and the inside surface of the toilet bowl rim, close to the rim and overlapping the rim. The other, inner flange extends downward a distance about equal to the diameter of the manifold. These channel flanges interrupt and deflect water flow from the openings in the manifold to cause such flow to clean the manifold and prevent the escape of any water between the seat and bowl rim. Water is supplied to the manifold by a tube attached to the bottom surface of the seat at a right angle to the manifold and connected to the manifold by a rotary joint. This tube extends laterally from the seat far enough to make a valve attached to it easily accessible to a person using the toilet.

This valve is used to turn off and turn on water flow to the manifold and to control the flow rate. Water is supplied to the valve through a flexible conduit which allows the seat to be raised and lowered.

Small sleeves are fitted onto the manifold, one next to each opening. The sleeves are movable along and held by friction in positions to which they are moved. Any and all manifold openings (orifices) can be closed off by these sleeves.

The invention is described in more detail below with reference to the attached drawings.

DETAILED DESCRIPTION OF THE INVENTION

Figure 1:
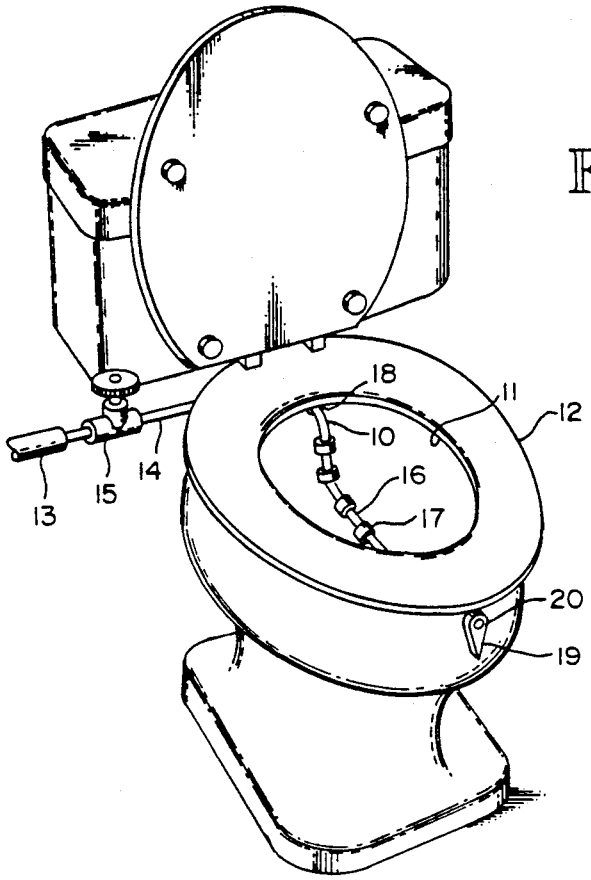
FIG. 1 is a perspective view of a toilet fitted with the subject invention with the apparatus positioned ready for use.
Figure 2:
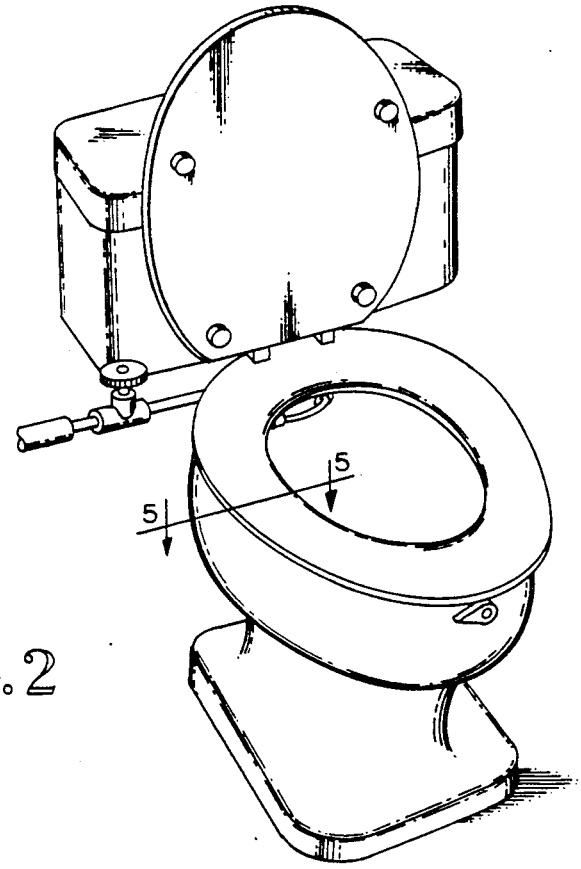
FIG. 2 is the same as FIG. 1 but with the apparatus in its stowed position.

The subject invention is spray apparatus for use on a toilet seat to serve the purposes of a bidet. FIG. 1 illustrates the apparatus installed on a conventional toilet and ready to provide the functions of a bidet. Manifold 10 is attached, as described below, to the underside 11 of seat 12 and supplied with water by flexible conduit 13 and tube 14 joined by valve 15 which is used to turn flow into the manifold on and off and to control the rate of flow. The manifold is attached along the axis of symmetry of the lower surface of the seat, front-to-back. Water is emitted from openings (orifices) in the manifold, orifice 16 being typical. There is a sleeve, sleeve 17 being typical, slidably mounted on the manifold near each orifice. The fit of the sleeves on the manifold is such that the sleeves can be moved along the manifold but are held in place by friction at the positions to which they are moved. They serve to shut off or turn on the flow from individual orifices. The manifold is connected to tube 14 by a liquid transmitting rotary joint 18 shown sectioned in FIG. 4, explained below. Lever 19, attached to the front end 20 of the manifold, is used to rotate the manifold from its in use position to its stowed position as shown in FIG. 2.

Figure 3:
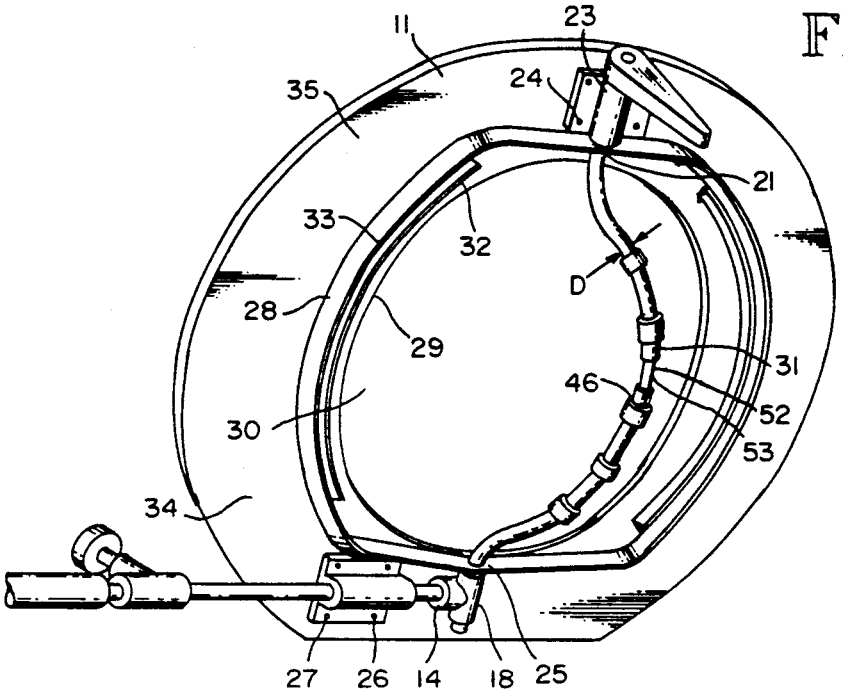
FIG. 3 is a perspective view of the apparatus as seen from below the toilet seat.

FIG. 3 is a view of the apparatus as seen from below the toilet seat. The forward portion 21 of the manifold is pivoted in hole 22, not visible in this view, in pillow block 23 which is attached to the undersurface 11 by suitable fasteners, fastener 24 being typical. The back portion 25 of the manifold is supported in rotary joint 18 which is in turn supported on tube 14 which is carried in pillow block 26 attached to surface 11 by suitable fasteners, fastener 27 being typical. The tube, the joint and the block constitute means for attaching the back portion of the manifold to the undersurface. Channel 28 is also attached by suitable means to surface 11. The channel is shaped to match contoured perimeter 29 of opening 30 of the toilet seat and is set back a small distance from the opening. Arched portion 31 of the manifold is shaped to fit between flanges 32 and 33 of the channel. The height of flange 32 is essentially equal to the diameter D of the manifold. The height of flange 33 is such that it extends well beyond top surface 51 of toilet bowl rim 48 (FIG. 5) and is in the range of ½ to 3 inches. Flange 32 extends from back portion 34 of the toilet seat to its front portion 35. Flange 33 extends essentially completely around opening 30. The flanges are essentially normal to the undersurface. The purpose of so positioning the manifold in the channel is explained below with reference to FIG. 5.

Figure 4:
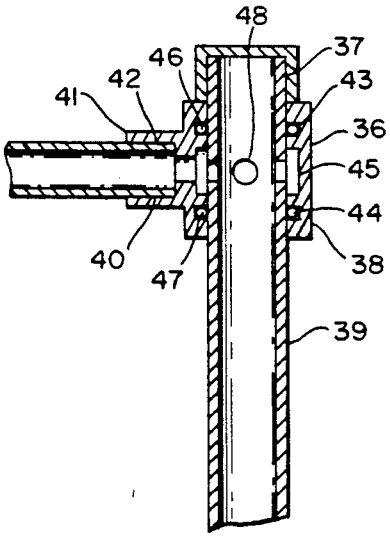
FIG. 4 is a sectioned view of a fluid conducting rotary joint.

FIG. 4 is a sectional view of rotary joint 18. The joint comprises tee fitting 36 having a bore 37 extending through the long portion 38 of the fitting to accept end 39 of the manifold and bore 40 in the stem 41 of the fitting accepting and fastened to end 42 of tube 14. In bore 37 there are two O-ring grooves 43 and 44 and a distribution groove 45. O-rings 46 and 47 in grooves 43 and 44 prevent leakage from the joint and groove 45 distributes water from tube 14 to flow around the manifold and through a plurality of orifices in the concave side 46 of the manifold, orifice 48 being typical. The centerline of the manifold lies in a flat plane and the front and back portions of the manifold are axially aligned.

Figure 5:
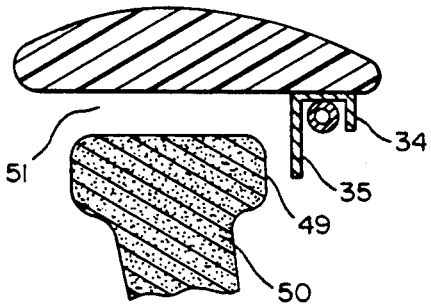
FIG. 5 is a section taken at 5—5 in FIG. 2.

FIG. 5 is a section taken at 5—5 in FIG. 3, showing the manifold stowed between the flanges of the channel and showing the orientation of the channel with respect to the rim 49 of toilet bowl 50. Water flowing from the orifice in the manifold is deflected off flange 32 back onto the manifold to remove contaminants. Flange 33 prevents any escape of water used for such cleaning through the gap 51 between the seat and the rim.

Gap 52 and elastomeric tube 53 provide an optional telescopic adjustment of the length of arched portion 31 of the manifold and thereby adjustment of the length of the manifold 10. Tube 52 is friction fit in the manifold. The rotational attachment of both ends of the manifold to the toilet seat, as detailed above, prevents the manifold from lengthening because of water pressure in the manifold. The manifold in FIG. 1 does not have the telescopic length adjustment.

It is considered to be understandable from this description that the subject invention meets its objectives. It provides apparatus for use on a toilet seat, which apparatus serves the purposes of a bidet. The spray source location is adjustable using the sleeves on the manifold; the manifold can be stowed out of sight by use of the lever; it is self cleaning in its stowed position and spray pressure is adjustable. Also, the apparatus is straight forward and uncomplicated, making it economical to manufacture and simple to install and use.

It is also considered to be understood that while one embodiment of the invention is disclosed herein, other embodiments and modifications of the one disclosed are possible within the scope of the invention which is limited only by the attached claims.

I claim:

1. Apparatus for use on a toilet seat to provide the functions of a bidet in dispensing a liquid, said seat having an undersurface, a front, a back and an axis of symmetry extending from said front to said back, said apparatus comprising:

a manifold having a front portion, an arched portion and a back portion, said arched portion extending between said front and back portions of said manifold and having a concave side, said front and back portions being axially aligned, said manifold further comprising a plurality of orifices in said concave side of said arched portion, means for rotatably attaching said front portion and said back portion of said manifold to said front and back seat undersurface, respectively, with said axially aligned portions aligned with said axis of symmetry, means for selectively closing off and opening each of said plurality of orifices, said means comprising a plurality of sleeves, one for each of said plurality of orifices, slidably mounted on said manifold such that each one of said orifices can be closed off by sliding one sleeve of said plurality of sleeves over one orifice of said plurality of orifices, said sleeves being frictionally restrained on said manifold, and means for conducting said liquid to said manifold.

2. The apparatus of claim 1 in which said manifold is telescopic.

3. Apparatus for use on a toilet seat to provide the functions of a bidet, said toilet seat having a front-to back axis of symmetry, an undersurface, an opening having a contoured perimeter and front and back seat portions, said apparatus comprising:

a manifold having a diameter, a front portion, a back portion and an arched portion extending between said front and back portions, said front and back portions being axially aligned, and said front, back and arched portions lying in a flat plane, said arched portion having a concave side, said manifold further having a plurality of orifices in said concave side of said arched portion, a liquid transmitting rotary joint, a tube having first and second ends, a lever, a valve, a channel, a plurality of sleeves, one for each orifice of said plurality of orifices, means for attaching said tube to said undersurface, means for attaching said front portion of said manifold rotatably to said undersurface of said front seat portion, said channel being shaped to fit around said opening, said channel being adapted to be fastened to said undersurface of said seat adjacent one side of said opening and having first and second flanges, extending essentially normal to said undersurface, said first flange having a first height, being closer to said opening than said second flange, and extending from said front portion to said back portion of said seat, said second flange having a second height, and extending essentially around said opening, said first height being essentially equal to said diameter, said second height being in a range of 1 to 3 inches, said rotary joint being attached to said first end of said tube, said back portion of said manifold being rotatably engaged in said rotary joint, said manifold, rotary joint and tube being attached to said undersurface of said back portion of said seat by said means for attaching said tube, and wherein said means for attaching said front portion of said manifold to said undersurface of said front seat portion and said rotary joint are axially aligned such that said front and back portions of said manifold are aligned with said front-to-back axis of symmetry, whereby said manifold is rotatable in said rotary joint and said means for attaching said front portion of said manifold, said arched portion being shaped to fit between said first and second flanges, said valve being attached to said second end of said tube, said lever being attached to said front portion of said manifold for rotating said manifold from a position in which said arched portion is in said channel to a position in which said plane is normal to said undersurface, said sleeves being slidable and frictionally restrained on said manifold and positioned such that each sleeve of said plurality of sleeves can be used to close off one orifice of said plurality of orifices by sliding one sleeve of said plurality of sleeves over one orifice of said plurality of orifices.

4. The apparatus of claim 3 in which said manifold is telescopic.

5. Apparatus for use on a toilet seat to provide the functions of a bidet in dispensing a liquid, said seat having an undersurface, a front, a back and an axis of symmetry extending from said front to said back, said apparatus comprising a manifold having a front portion, an arched portion and a back portion, said arched portion extending between said front and back portions of said manifold and having a concave side, said front and back portions being axially aligned, said manifold being telescopic and further comprising a plurality of orifices in said concave side of said arched portion, means for rotatably attaching said front portion and said back portion of said manifold to said front and back seat undersurface, respectively, with said axially aligned portions aligned with said axis of symmetry, means for conducting said liquid to said manifold.

6. Apparatus for use on a toilet seat to provide the functions of a bidet, said toilet seat having a front-to back axis of symmetry, an undersurface, an opening having a contoured perimeter and front and back seat portions, said apparatus comprising:

a manifold having a diameter, a front portion, a back portion and an arched portion extending between said front and back portions, said front and back portions being axially aligned, and said front, back and arched portions lying in a flat plane, said arched portion having a concave side, said manifold further having a plurality of orifices in said concave side of said arched portion, a liquid transmitting rotary joint, a tube having first and second ends, a lever, a valve, a channel, means for attaching said tube to said undersurface, means for attaching said front portion of said manifold rotatably to said undersurface of said front seat portion, said channel being shaped to fit around said opening, said channel being adapted to be fastened to said undersurface of said seat adjacent one side of said opening and having first and second flanges, extending essentially normal to said undersurface, said first flange having a first height, being closer to said opening than said second flange, and extending from said front portion to said back portion of said seat, said second flange having a second height, and extending essentially around said opening, said first height being essentially equal to said diameter, said second height being in a range of 1 to 3 inches, said rotary joint being attached to said first end of said tube, said back portion of said manifold being rotatably engaged in said rotary joint, said manifold, rotary joint and tube being attached to said undersurface of said back seat portion of said seat by said means for attaching said tube, and wherein said means for attaching said front portion of said manifold to said undersurface of said front seat portion and said rotary joint are aligned such that said front and back portions of said manifold are aligned with said front-to-back axis of symmetry, whereby said manifold is rotatable in said rotary joint and said means for attaching said front portion of said manifold, said arched portion being shaped to fit between said first and second flanges and being telescopic, said valve being attached to said second end of said tube, said lever being attached to said front portion of said manifold for rotating said manifold from a position in which said arched portion is in said channel to a position in which said plane is normal to said undersurface.

* * * * *